United States Patent [19]

Rayer

[11] Patent Number: 4,632,219

[45] Date of Patent: Dec. 30, 1986

[54] ROOF LADDER

[76] Inventor: Paul H. Rayer, P.O. Box 4866, Woodland Park, Colo. 80866

[21] Appl. No.: 765,071

[22] Filed: Aug. 12, 1985

[51] Int. Cl.[4] ..... E06C 5/36; E06C 1/36

[52] U.S. Cl. ..... 182/45; 182/107; 182/206; 182/228

[58] Field of Search ..... 182/45, 107, 108, 206, 182/228; 248/237

[56] References Cited

U.S. PATENT DOCUMENTS

| | | | |
|---|---|---|---|
| 341,178 | 5/1886 | Specht | 182/45 |
| 524,661 | 8/1894 | Austin | 182/45 |
| 599,963 | 3/1898 | Hatch | 182/206 |
| 1,028,362 | 6/1912 | King | 182/45 |
| 1,143,555 | 6/1915 | Schimmelpfennig | 182/45 |
| 1,248,228 | 11/1917 | West | 182/108 |
| 1,379,808 | 5/1921 | Fies | 182/111 |
| 1,684,269 | 9/1928 | Hebner | 182/108 |
| 1,743,371 | 1/1930 | Montag | 182/45 |
| 2,476,401 | 7/1949 | Campion | 182/45 |
| 4,184,569 | 1/1980 | Grenier | 182/206 |
| 4,311,207 | 1/1982 | Lurry | 182/206 |

FOREIGN PATENT DOCUMENTS

| | | | |
|---|---|---|---|
| 1138903 | 10/1962 | Fed. Rep. of Germany | 182/108 |

*Primary Examiner*—Reinaldo P. Machado

*Attorney, Agent, or Firm*—Alan H. MacPherson; Steven F. Caserza; Richard Franklin

[57] ABSTRACT

A ladder attachment is provided for holding a ladder on a sloping roof. Sharp, pointed members or claws are attached to the ladder which, in operation, protrude from the ladder in a direction facing the roof. The sharp, pointed members pierce into the roof a selected distance at a selected angle and hold the ladder on the roof without sliding. Multiple non-skid surfaces are also provided on the rungs of the ladder for supporting the user.

3 Claims, 20 Drawing Figures

ROOF LADDER

FIELD OF THE INVENTION

This invention relates to a ladder and particularly to a ladder especially adapted for use on sloping roof surfaces.

BACKGROUND

It is often necessary for construction workers, repairmen, fire fighters, and maintenance workers to move safely across a sloping surface such as a roof which may not offer a user sufficient friction for safe maneuvering, or which may not be uniformly able to support the weight of the person. In such cases, something is needed to assist the person. Ladders having hooks which engage the ridge of a roof and thus prevent sliding are known and are described in U.S. Pat. Nos. 599,963, 4,184,569, and 4,311,207, for example. These ladders provide sufficient safety, but are not useable where a roof ridge is unavailable. Requiring the user to contact the ridge line in order to engage the hooks may be difficult for a very large roof or impossible in the case of a sloping roof which meets a vertical wall at its upper edge.

SUMMARY OF THE INVENTION

In accordance with this invention, a ladder is provided which is compact, easily portable and is adapted to frictionally and nonslidably engage the surface of a sloping roof, thus allowing a user to move freely on the ladder, up, down and across a roof of any size and across roofs having a variety of pitches without requiring that the ladder contact a ridge.

The ladder of this invention includes a set of claws, cleats or spikes which grip a sloping roof and a rung shape which provides optimal user support and comfort on a variety of surfaces such as roofs having both very steep pitch and relatively shallow pitch. The ladder of this invention is appropriate for normal use on shake or shingle roofs which can tolerate small indentations made by the claws, cleats or spikes without leaking or otherwise deteriorating. It is also appropriate for emergency use such as fire-fighting on roofs having a sealed surface where perforations made by the ladder can be later repaired. In one embodiment, claws are riveted or bolted to the back surface (i.e. roof-facing surface) of the ladder rails or rungs so that when the ladder is placed on a roof, the claws dig into the roof surface and provide a firm, nonskid grip to support the ladder. The rungs also have nonskid surfaces, preferably of more than one pitch, so the user is well supported on roofs having a variety of pitches.

The upper claws can also be hooked across the ridge of a roof in order to move from one side of the ridge to the other, or to provide additional stability when working near the ridge.

Two ladders of this invention can be used in combination and can be tied together with a rope or other connecting means to provide ease in moving one ladder with respect to the other or to provide support for a plank or platform on which a user can move across the roof. When two ladders of this invention are used in combination, the user can move freely across a large, steep roof quickly and in relative safety.

DETAILED DESCRIPTION OF THE INVENTION

Several embodiments of the roof ladder of this invention will be described. Generally, the ladder of this invention has two rails of selected length. In one embodiment the rails are four feet long so that the ladder is easily handled by one person but, in general, the rails may be any selected length so long as the ladder can be easily handled in accordance with job requirements. A selected number of rungs are set between the two rails, generally but not necessarily evenly spaced, and a selected number of bracket members which can be cleats, claws or spikes are attached to the rails to project toward the roof at a selected angle from the back side (i.e., the side which faces the roof) of the ladder. Claws, cleats or spikes provide the ladder of this invention with the unexpected advantage of being able to dig into the surface of a shake or shingle roof and thus provide a firm, nonskid grip between the ladder and the roof surface to support a user moving about on the roof, without causing the roof to leak or causing other serious injury to the roof. Of course, the ladder could be of other lengths, have a different number of rungs and have a different number of claws for gripping the roof surface. Also spikes or pointed plates can be attached to the sides of the rails rather than to the surface facing the roof. Several embodiments are described below.

Figure 1A:
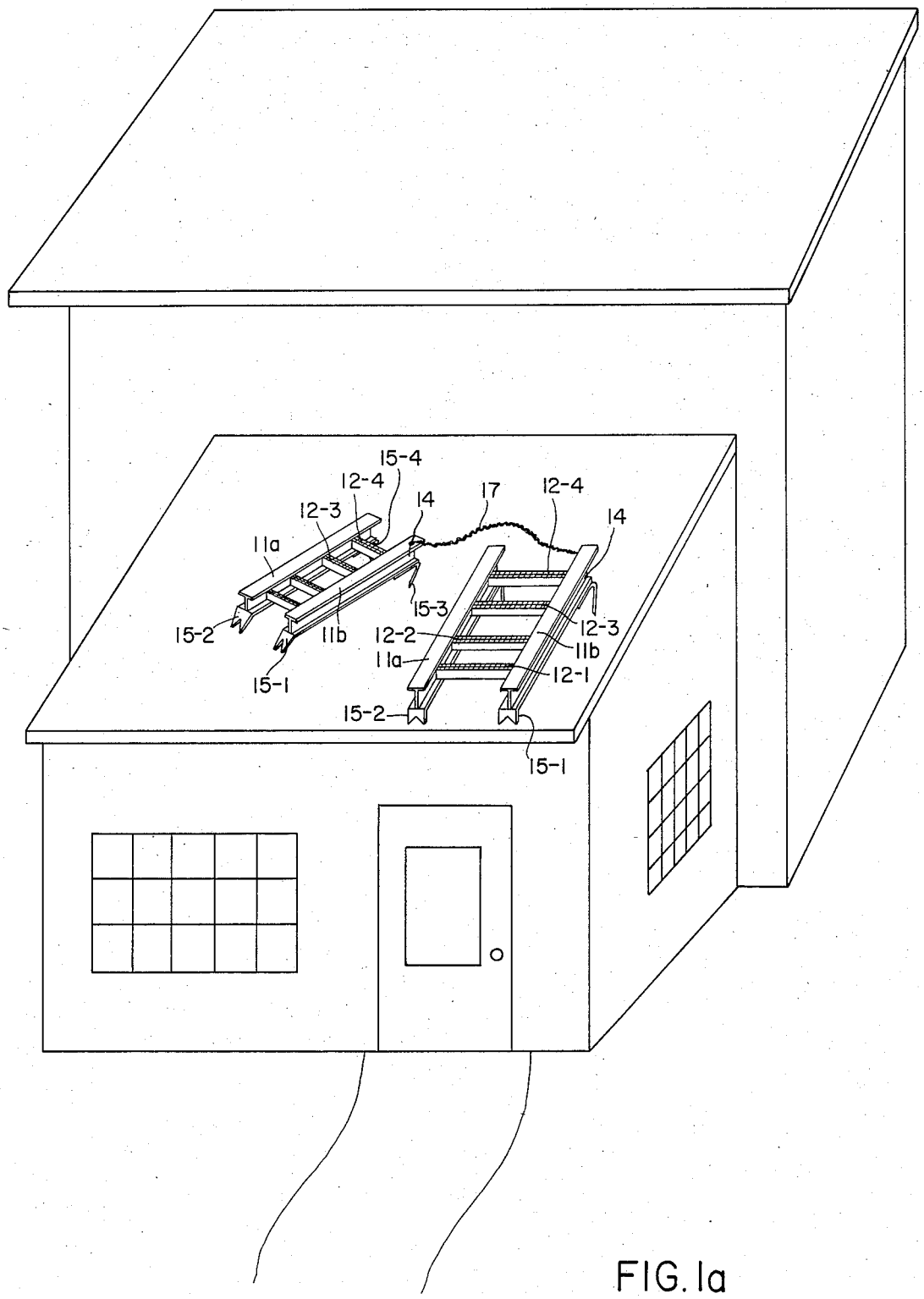
FIG. 1*a* shows a building have a sloping roof and on which a user has employed a pair of roof ladders designed according to the teachings of this invention.

As shown in FIG. 1*a*, one embodiment uses four claws 15-1, 15-2, 15-3, 15-4, one on each corner of the structure, all attached to the face of the ladder which will be placed against the roof. FIG. 1*a* shows two ladders of this invention used in combination, attached by rope 17 which is tied to attachment means 14, e.g., a hook. Rope 17 can be used by a user who is standing on one ladder to move the other ladder across the roof.

One ladder embodiment is shown in FIGS. 2*a* through 2*d*. The ladder of FIGS. 2*a*–2*d* has two side rails 11*a* and 11*b* of extruded aluminum alloy, 6061 classification, 48 inches long of an I-beam cross section. Between the two spaced rails 11*a* and 11*b* extending at right angles are four rungs 12-1, 12-2, 12-3 and 12-4, which are all the same length, some 13 to 16 inches long, spaced some 8 inches apart and which are also of extruded aluminum alloy 6061 classification in 7-gauge plate and stamped with nonskid surfaces.

Both ends of rungs 12-1 to 12-4 are welded to end plates, which are in turn riveted to rails 11*a*, 11*b* each end with four aluminum alloy rivets such as 13–3*a*, 13–3*b*, 13–3*c*, 13–3*d*. FIG. 2*b* shows end plates 12–1*d*, 12–2*d*, 12–3*d* and 12–4*d* which are riveted to rail 11*b*. In the embodiment shown in FIGS. 2*a*–2*d*, claws 15*a*–15*d* are steel plate 0.1875 inches thick, riveted to the rails 11*a*, 11*b* with steel rivets (not shown). Of course, different materials, different thicknesses, and different methods of attachment can be used if appropriate and desired.

An important feature of the invention is to provide sharp pointed members protruding downward toward the roof from the roof-facing surface of the ladder. The sharp pointed members may be claws or cleats bent to angles selected so that when attached to the ladder, all the claws or cleats extend toward the roof in parallel or approximately parallel. As a result, when the claws or cleats are being pressed into the roof by the weight of the user, they all move in the same direction so there is no splaying force on the roof caused by downward motion of the ladder forcing the claws into the roof at different angles. This parallel arrangement of claws on the ladder increases the life of the claws and of the roof ladder of this invention.

The roof-piercing members achieve their nonsliding result by piercing the roof's surface a small distance so that a side of the member presses against the roof material located on the down side of the roof piercing member and prevents tangential movement of the ladder. The principle of this invention differs from that of a fire escape ladder or other ladder permanently attached to a roof which derives part of its support from friction between the ladder surface and the roof surface resulting from the compression cause by the screws, bolts, or nails attaching the permanent ladder to the roof.

In order to prevent the roof-piercing members from piercing into the roof so far that permanent damage to the roof might occur, protrusions or stops may be attached to the piercing members a small distance from the points. Different distances from the points are preferred for different roof surfaces. For a rough shake roof of steep pitch, the optimal distance from the points to the stops would be longer than for a shingle roof of shallower pitch. Alternatively, the degree of penetration may be controlled by selecting the angle at which the roof piercing members are sharpened. A point sharpened at a narrow angle will pierce farther than a point which broadens quickly. Again, a steeply pitched roof may require points which are sharpened more narrowly and a shallower roof may require points which are sharpened more broadly.

Figure 2A:
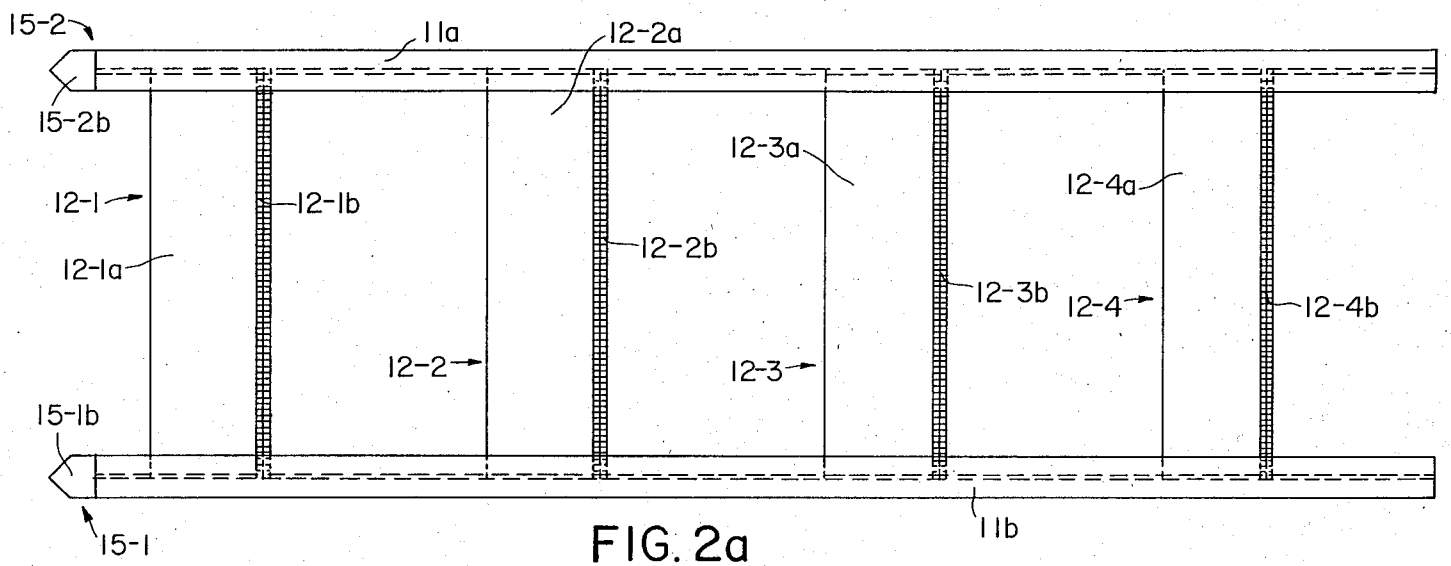
FIG. 2*a* is a plan view of a 4-claw embodiment of the roof ladder of this invention showing single pointed claws at the bottom of the ladder rails.
Figure 2B:
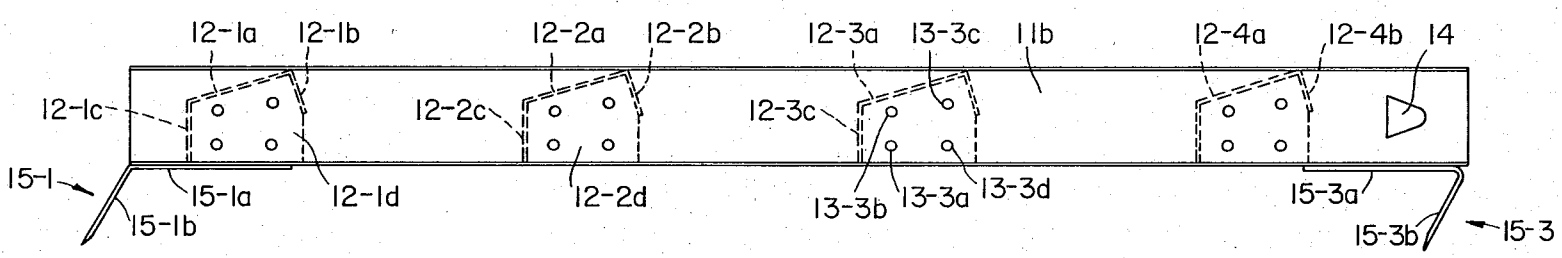
FIG. 2*b* is a side view of the ladder of FIG. 2*a* showing the claws.
Figure 2C:
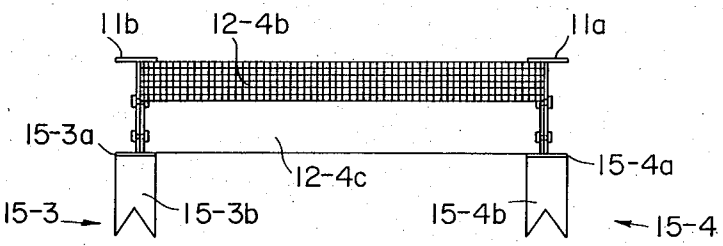
FIG. 2*c* is a top end view of the ladder of FIGS. 2*a* and 2*b* having double pointed claws and rungs having one nonskid checkered surface.
Figure 2D:
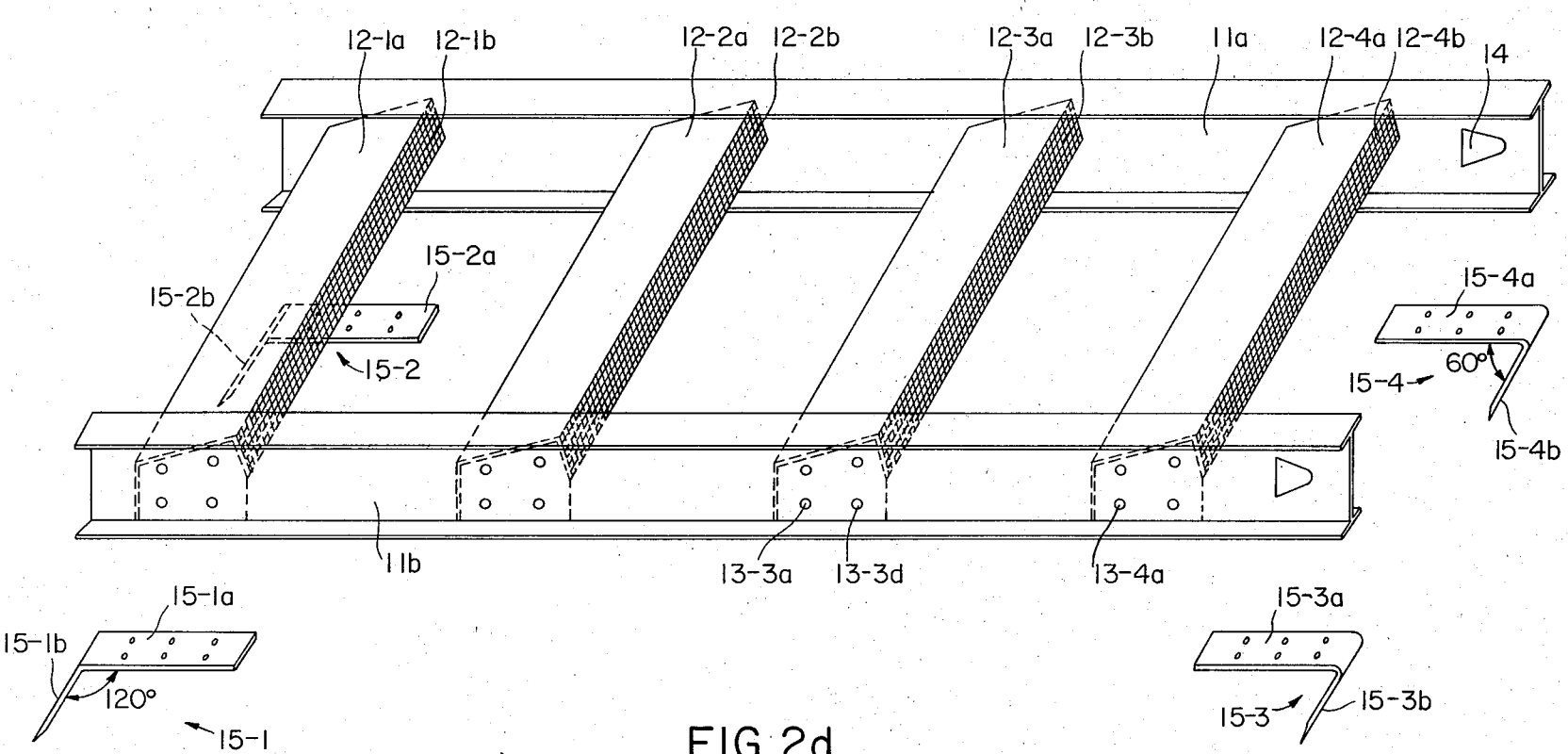
FIG. 2*d* is a perspective view of the ladder of FIGS. 2*a*, 2*b* and 2*c* with the claws in exploded position.

As shown in FIGS. 2*b* and 2*d*, lower claws 15-1 and 15-2 are metal plates bent to an oblique angle, preferably 120° to 140° and sharpened on their outer ends. Upper claws 15-3 and 15-4 are metal plates bent to the supplementary angle of the lower claws, between 40° and 60° as shown in FIGS. 2*b* and 2*d* so that when attached, the protruding portions 15–1*b*, 15–2*b*, 15–3*b* and 15–4*b* of the upper and lower claws will be parallel to each other. The angles given above are optimal for a roof having a pitch between 30° and 50° but are also useful for other slopes, because the claw points will attach to the pitched surface of a roof or other sloping surface having any one of a variety of different pitches.

FIGS. 2*b* and 2*d* also show safety tie 14, typically a hole cut through the rail, or a hook attached to the rail. Safety tie 14 is useful for attaching a rope or chain for connecting one ladder to another, or for tying a rope or chain to a ridge hook, to the user, or to another device to provide extra maneuverability or safety.

FIG. 2*c* shows the ladder of FIGS. 2*a* and 2*b* as seen from the upper end, which is to the right as shown in FIGS. 2*a* and 2*b*. Nonskid checkered surface 12–4*b* is shown. FIG. 2*c* indicates that claws 15-3 and 15-4 are double pointed. Generally a larger number of points is selected when reduced roof penetration is desired.

Figure 1C:
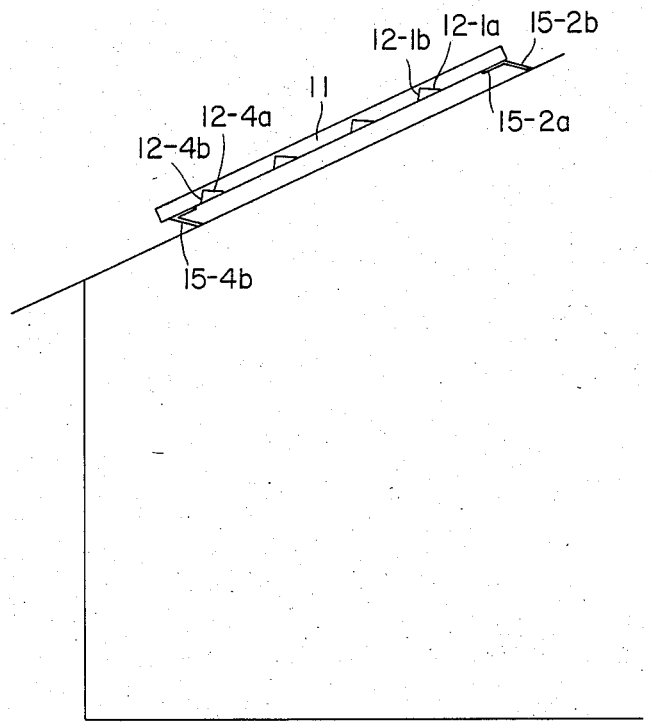
FIGS. 1*b* and 1*c* show possible ladder orientations on roofs of steep and shallow pitches.
Figure 1B:
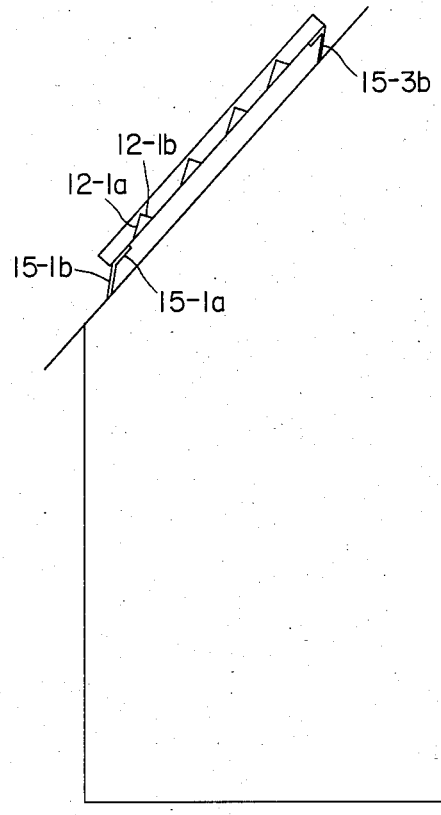

FIG. 2*d* shows the ladder of this embodiment in which only one surface of each rung 12–1*b*, 12–2*b*, 12–3*b*, 12-4*b* is stamped with a nonskid surface. In some applications it is preferable to also stamp the rung surface 12-1*a*, 12-2*a*, 12-3*a*, 12-4*a* most closely parallel to the direction of the rails 11a, 11b with a nonskid surface. For use on a roof or other location having shallow pitch, as shown in FIG. 1*c*, the ladder may be turned in a direction with the upper claws 15-3 and 15-4 at the lowest ladder elevation so that rung surfaces 12-1*a*, 12-2*a*, 12-3*a* and 12-4*a* are nearly horizontal, allowing the user more comfort in standing on a shallow, sloping surface. Alternatively, the ladder may be provided with rungs (not shown) having two pitches of nonskid rung surface that both face the end of the ladder having claws 15-3 and 15-4. In this embodiment the end of the ladder with claws 15-3 and 15-4 is always placed toward the upper portion of the roof and the user stands on the rung surface which is more nearly horizontal.

Figure 3A:
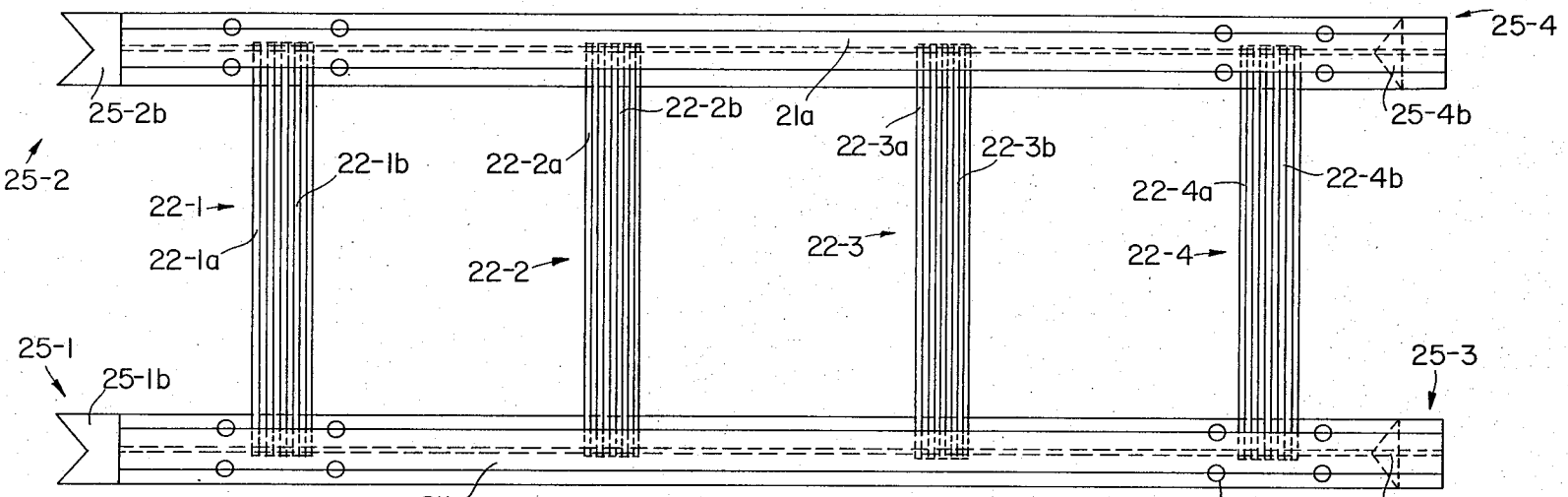
FIG. 3*a* is a plan view of a second embodiment of the roof ladder of this invention showing both single and double pointed claws.
Figure 3B:
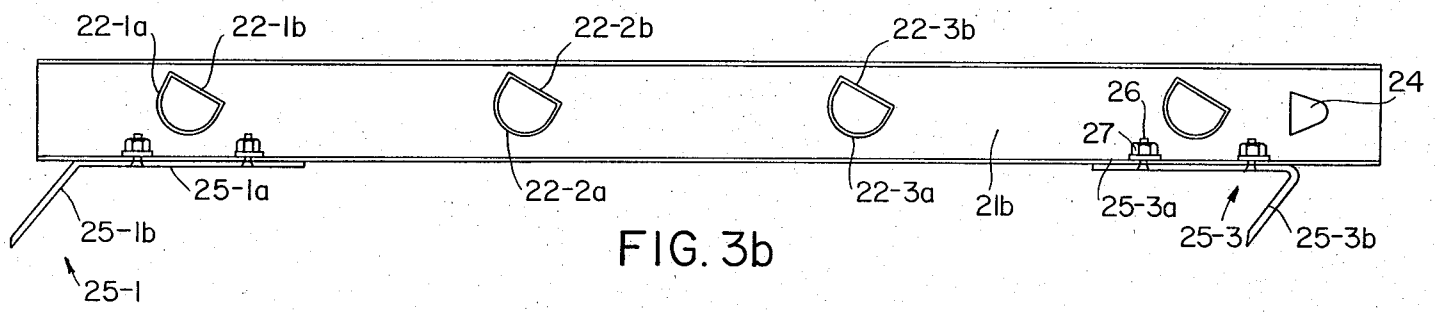
FIG. 3*b* is a side view of the second embodiment, showing rungs having swaged shoulders.
Figure 3C:
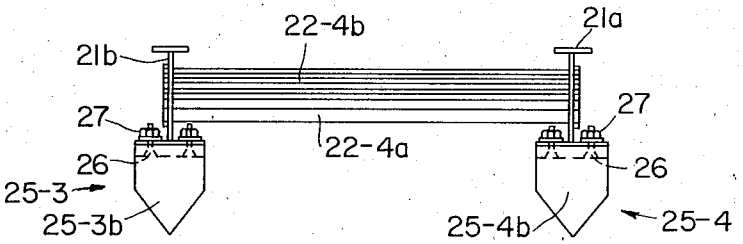
FIG. 3*c* is an end view of the ladder of FIG. 3*a* showing single pointed claws attached to the ladder by nuts and bolts.

A further embodiment is shown in FIGS. 3*a* through 3*c*. The embodiment of FIGS. 3*a* through 3*c* possesses two rails 21*a* and 21*b*, again of I-beam cross section, spaced apart and connected by a plurality of rungs 22-1, 22-2, 22-3, 22-4 running in a direction perpendicular to the direction of rails 21*a* and 21*b*. The rails have a D-shaped cross section as shown in FIG. 3*b* with the flat sides 22-1*b*, 22-2*b*, 22-3*b*, 22-4*b* oriented perpendicular to the direction in which the claws 25-1, 25-2, 25-3 and 25-4 protrude. In this embodiment, the claws are of steel plate 0.25 inches thick and are attached to rails 21 with four ⅜ inch diameter by ¾ inch length 114° countersunk square-neck bolts 26, which are held taut by lock washer and nut 27. The angle of lower claws 25-1, 25-2 in FIG. 3*b* is 130°; and the angle of upper claws 25-3, 25-4 is 50°. Of course, other angles and dimensions can also be selected.

Figure 5A:
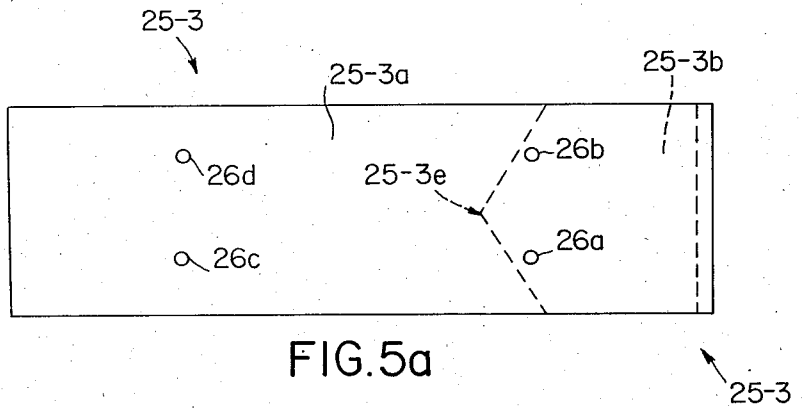
FIGS. 5*a*–5*f* show two embodiments of claw construction using the teachings of this invention.

The claws, according to one embodiment, are constructed as shown in FIGS. 5*a* through 5*f*. FIG. 5*a* shows a top view of one of the single-pointed claws 25-3 which is attached to the top end of the ladder rails shown in FIGS. 3*a* through 3*c*. In this embodiment, a claw for attaching to the top end of a rail is made from a piece of rectangular steel plate, twelve inches long by 2½ inches wide, 0.25 inches thick. Into this steel plate are drilled four ⅜ inch diameter holes 26*a*, 26*b*, 26*c*, 26*d* machined for 114° countersunk square-neck bolts. FIG.

Figure 5B:
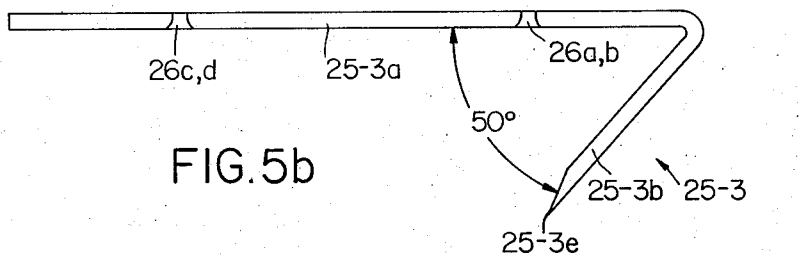
Figure 5C:
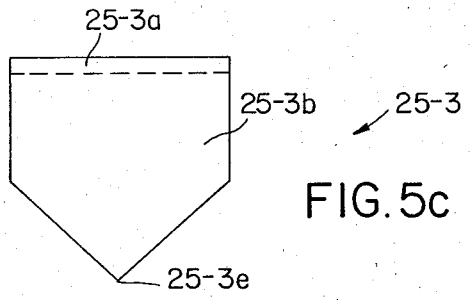

5*b* shows the side view of this same claw, in which the steel plate is bent at an angle of 50° to form two legs, 25-3*a* and 25-3*b*. Leg 25-3*a* which is to be attached to the ladder and in which are drilled the four holes, is eight inches long and leg 25-3*b*, which is to protrude from the ladder, is four inches long. Leg 25-3*b* is first cut at its end to have a triangular point 25-3*e* as shown in FIG. 5*c*, and this triangular point 25-3*e* is further sharpened as shown in FIG. 5*b* to reduce the plate thickness as the point is approached.

Figure 5D:
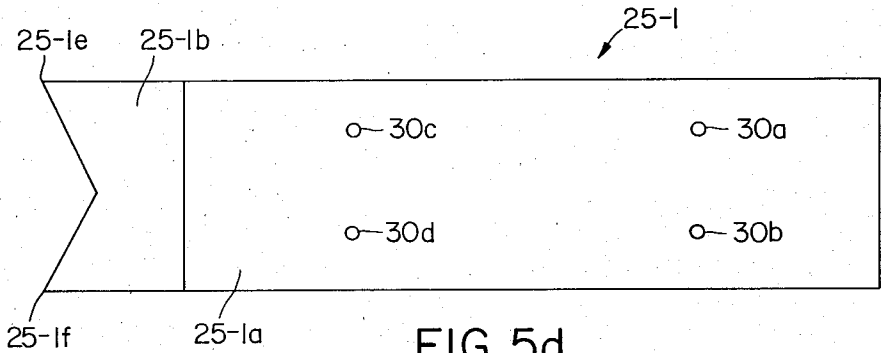
Figure 5E:
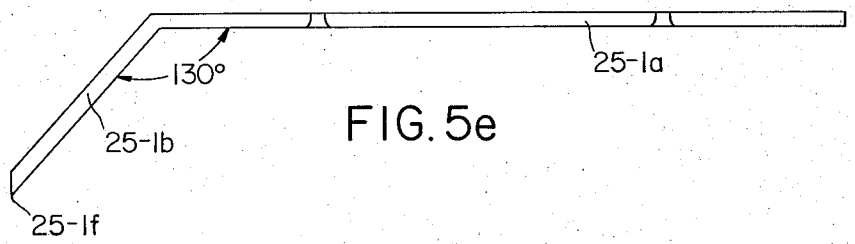
Figure 5F:
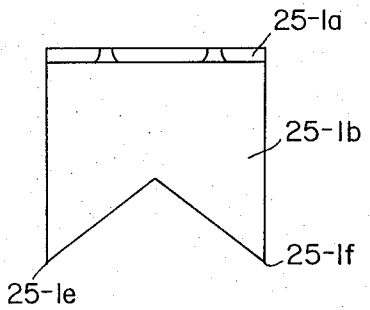

FIG. 5*d* shows a top view of a lower claw 25-1, also rectangular steel plate, twelve inches long by 2½ inches wide and 0.25 inches thick. Also into a first portion 25-1*a* of this steel plate intended for attaching to the ladder are drilled four ⅜ inch diameter holes 30*a*, 30*b*, 30*c* and 30*d*, machined for 114° countersunk square-neck bolts. FIG. 5*e* shows the side view of lower claw 25-1 in which leg 25-1*a*, which is drilled to be attached to the ladder, is also 8 inches long and leg 25-1*b*, which is to protrude from the ladder, is 4 inches long. The steel plate is bent to form an angle of 130° between the two legs. As shown in FIG. 5*f*, leg 25-1*b* is cut to have a v-shaped notch, leaving two points, 25-1*e*, 25-1*f* at the outer edges of the end which will protrude from the ladder. As shown in FIG. 5*e*, points 25-1*e*, 25-1*f* are ground to decrease the thickness of the steel plate as the points are approached.

Figure 4A:
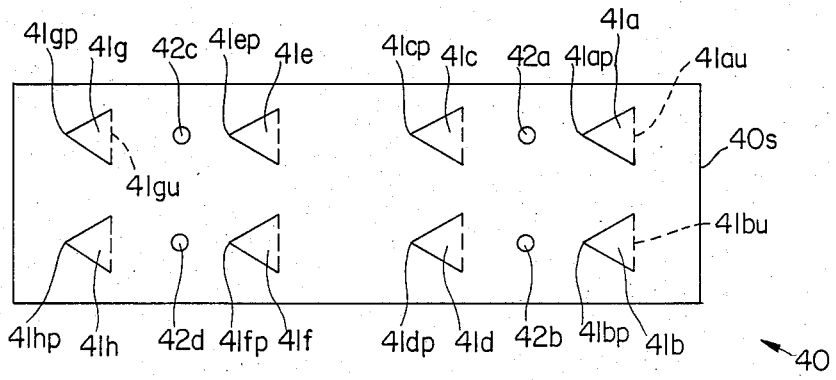
FIG. 4*a* shows a cleat plate design for attaching to a ladder of this invention.
Figure 4B:
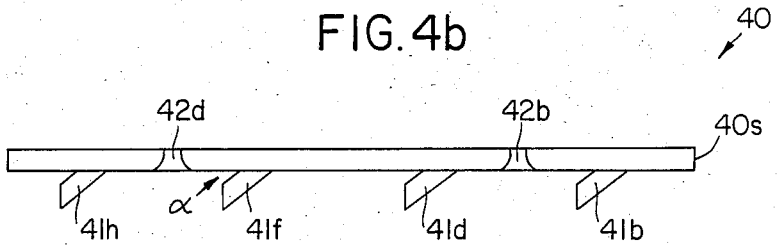
FIG. 4*b* is a side view of the cleat plate design of FIG. 4*a*.
Figure 4C:
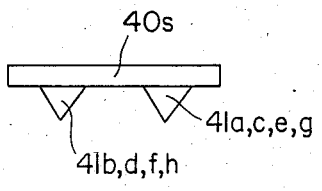
FIG. 4*c* is an end view of the cleat plate design of FIGS. 4*a* and 4*b*.

Another embodiment of roof-gripping sharp-pointed members is shown in FIGS. 4*a* through 4*c*. Rather than forming a claw from a steel plate bent to an angle, a single flat steel plate 40, eight inches by 2½ inches in the embodiment shown in FIG. 3*a*, is marked at selected locations with triangles 41*a* through 41*h* which are then cut on two sides, forming cut points (cleats) 41*ap* through 41*hp*. The orientation is such that the points 41*ap* through 41*hp* formed between the two cut edges point parallel to the long edge of the rectangular steel plate, i.e., toward one end of the steel plate, and the uncut side of each triangle is parallel to the short edge 40*s* or perpendicular to the long edge of the rectangular steel plate. The cut triangles 41*a* through 41*h* are bent along the uncut sides 41*au* through 41*hu* so that the triangular points protrude from one side of the steel plate at an acute angle $\alpha$. These bent triangle sections form cleats, which are then ground to points 41*ap*–41*hp* with the points ground in a direction to decrease the thickness of the steel plate as the points are approached. Also, four ⅜ inch holes 42*a*–42*d* are drilled into the steel plates for attaching to a ladder. These steel cleat-bearing plates 40 can then be attached to the roof-facing surface of a ladder with their cleats pointing outward from the ladder and toward the base of the ladder.

As with the previous ladder embodiment, claws 25-1 and 25-2 or cleat plates 40 are attached to the corners of the ladder near the lower ends of each of the rails 21*a* and 21*b* and claws 25-3 and 25-4 or cleat plates 40 are attached to the corners of the ladder near the upper ends of each of the rails 21*a* and 21*b* of FIG. 3*a*. As in the previous ladder embodiment, there are four rungs 22-1 through 22-4. And as in the previous ladder embodiment, the rails are 48 inches long. Unlike the previous ladder embodiment, claws 25*a*, 25*b*, 25*c* and 25*d* or cleat plates 40 are bolted to rail 21, making them removable for greater flexibility in use of this ladder and allowing one set of claws or cleat plates to be used on different ladders.

Of course, the claws can be serrated or otherwise sharpened to achieve a good hold on a sloping surface. A design using single pointed claws is chosen when the intent is to provide maximum gripping support. A design using serrations or multiple teeth is chosen to minimize roof penetration by the teeth. Using multiple cleats formed in steel plates has the advantage of further spreading the support of the ladder over a wider roof area and minimizing roof penetration from the individual cleats. Using single or double pointed claws has the advantage of achieving positive penetration through hard surfaces, thus achieving a firm hold even on relatively steep and relatively impenetrable roofs.

In a preferred embodiment, four claws or cleat plates are attached as shown in FIGS. 2*a* through 2*d* and 3*a* through 3*c*, one to each upper and lower end of each rail, with all sharpened ends pointing in the same direction. Of course, other numbers of cleats or claws could be attached to the rails, or in fact, to the rungs of the ladder, thus still employing the principles of this invention.

Figure 6:
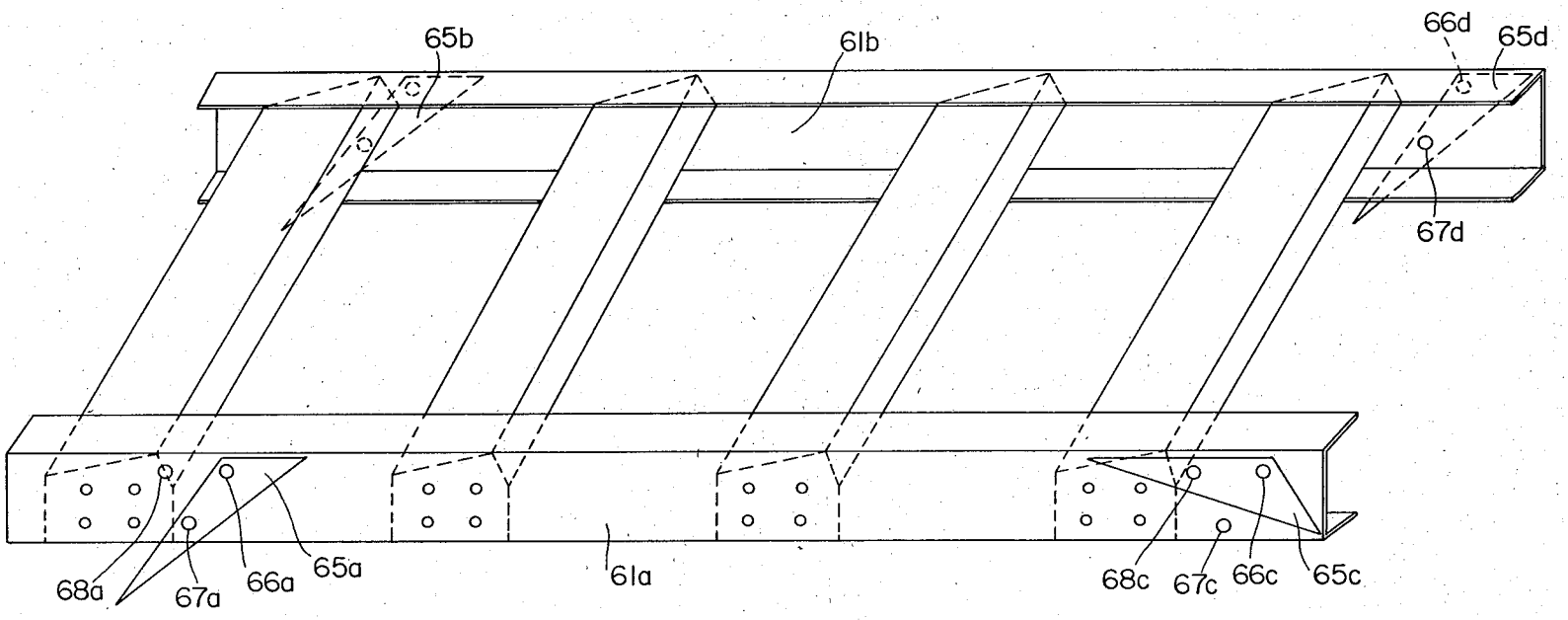
FIG. 6 shows a folding spike for attachment to a ladder using the teachings of this invention.

Another embodiment of roof-gripping sharp-pointed members, shown in FIG. 6, provides single pointed plates or spikes attached to the sides of the rails which can be turned to protrude or turned not to protrude from the back surface of the ladder. This embodiment allows the pointed plates or spikes to be folded flat against the rails when not in use. In the embodiment of FIG. 6, rails 61*a* and 61*b* are of U-shaped cross-section with the hollow portion of the U facing inward toward the rungs. Pivotally attached to the outer sides of the rails 61*a*, 61*b*, are pointed plates or spikes 65*a*, 65*b*, 65*c*, 65*d*. These spikes are held to the flat outer sides of the ladder rails by spring loaded pivotal shafts indicated symbolically by 66*a*, 66*b* (not shown), 66*c*, 66*d*. Also attached to the outer sides of the ladder rails are pins 67*a*–67*d* and 68*a*–68*d*. Spikes 65*a*–65*d* can be pulled away from the rails so that a hole appropriately placed in the spike can be positioned on its associated pin. For example, spike 65*a* is held by spring loaded shaft 66*a*, and its corresponding hole can be fitted over pin 68*a* to put spike 65*a* into a position for storage or for ladder use when the spike is not needed. Spike 65*a* can be moved to a position where the hole fits over pin 67*a*, thus firmly seating spike 65*a* into a position for use. FIG. 6 shows spike 65*a* in a position for use and shows spike 65*c* in a folded position. This folding mechanism increases the flexibility and usefulness of the ladder and ease of storage when not in use. Other folding mechanisms well known in the art would also work with the folding spikes of this invention.

Other embodiments of this invention will be obvious to those skilled in the art in light of the detailed descriptions which have been provided herein. The descriptions contained herein are meant to be descriptive only and not limiting.

I claim:

1. A roof ladder having parallel spaced apart rails connected by a plurality of rungs spaced apart and running transversely between said rails;

said ladder provided with pointed members which can protrude from one face of said ladder to engage a sloping surface;

said ladder also provided with means for attaching a rope, chain, or cable; and each of said rungs provided with first and second surfaces for supporting a user, said first surface oriented to be horizontal when said ladder is at a steep inclination angle and said second surface oriented to be horizontal when said ladder is at a shallow inclination angle.

2. A roof ladder as in claim 1 in which said pointed members are fixedly attached to protrude from one face of said ladder.

3. A roof ladder as in claim 1 in which said pointed members are movably attached to said ladder so they can be moved to protrude or not protrude from one face of said ladder.

* * * * *